US008696819B2

(12) United States Patent
Boggs

(10) Patent No.: US 8,696,819 B2
(45) Date of Patent: Apr. 15, 2014

(54) METHODS FOR CLEANING TUBULARS USING SOLID CARBON DIOXIDE

(76) Inventor: Arlie Mitchell Boggs, Baytown, TX (US)

( * ) Notice: Subject to any disclaimer, the term of this patent is extended or adjusted under 35 U.S.C. 154(b) by 561 days.

(21) Appl. No.: 12/435,948

(22) Filed: May 5, 2009

(65) Prior Publication Data

US 2009/0277473 A1 Nov. 12, 2009

Related U.S. Application Data

(60) Provisional application No. 61/050,715, filed on May 6, 2008.

(51) Int. Cl.

| | |
|---|---|
| ***B08B 7/00*** | (2006.01) |
| ***B08B 9/04*** | (2006.01) |
| ***B08B 9/00*** | (2006.01) |
| ***B08B 9/027*** | (2006.01) |

(52) U.S. Cl.
USPC ..... 134/7; 134/6; 134/8; 134/22.1; 134/22.11

(58) Field of Classification Search
USPC ..... 134/22.11, 6, 7, 22.12, 24, 42
See application file for complete search history.

(56) References Cited

U.S. PATENT DOCUMENTS

| | | | | |
|---|---|---|---|---|
| 1,605,617 A | | 11/1926 | Ruemelin | |
| 1,890,164 A | | 12/1932 | Rosenberger | |
| 2,089,597 A | * | 8/1937 | Carter | 451/76 |
| 3,137,974 A | | 6/1964 | Kirkland | |
| 4,036,173 A | * | 7/1977 | Nicklas | 118/306 |
| 4,038,786 A | * | 8/1977 | Fong | 451/39 |
| 4,411,705 A | | 10/1983 | Easley, Jr. et al. | |
| 4,439,954 A | | 4/1984 | Bennett | |
| 4,655,847 A | | 4/1987 | Ichinoseki et al. | |
| 4,815,241 A | | 3/1989 | Woodson | |
| 4,965,968 A | * | 10/1990 | Kelsall | 451/99 |
| 5,002,120 A | | 3/1991 | Boisture et al. | |
| 5,107,764 A | * | 4/1992 | Gasparrini | 101/425 |
| 5,123,207 A | * | 6/1992 | Gillis et al. | 451/89 |
| 5,160,548 A | | 11/1992 | Boisture | |
| 5,184,427 A | | 2/1993 | Armstrong | |

(Continued)

OTHER PUBLICATIONS

International Searching Authority, "Notification of Transmittal of the International Search Report and the Written Opinion of the International Searching Authority, or the Declaration," PCT2009/042943 mailed Jun. 25, 2009.

*Primary Examiner* — Eric Golightly
*Assistant Examiner* — Arlyn I Rivera-Cordero
(74) *Attorney, Agent, or Firm* — Edmonds & Nolte, P.C.

(57) ABSTRACT

Systems and methods for cleaning the interior surfaces of tubular members are provided. A flexible conduit having a nozzle disposed on an end can be disposed within the bore of a tubular to be cleaned. The nozzle can have an internal 5-15 degree tapered section with a length-to-diameter ratio of greater than about 2:1. The nozzle can have an outer diameter that is about 80% to 99% of the inner diameter of the tubular. A fluid suspension containing air and solid carbon dioxide can be passed through the nozzle, impinging the surrounding inner surface of the surrounding tubular as the nozzle is disposed within the tubular. The solid carbon dioxide and compressed air suspension can have a solids concentration of from about 0.1% to 10.0% solids. The solids delivery rate through the nozzle can range from about 0.5 lbs/minute to about 5 pounds/minute. The flow of the suspension through the nozzle can be controlled using a remote device.

13 Claims, 3 Drawing Sheets

(56) References Cited

U.S. PATENT DOCUMENTS

| | | | | |
|---|---|---|---|---|
| 5,525,093 | A | 6/1996 | Palmer, Jr. | |
| 5,632,150 | A | 5/1997 | Henzler | |
| 5,910,042 | A * | 6/1999 | Niechcial | 451/39 |
| 5,932,026 | A | 8/1999 | Trampusch | |
| 6,174,225 | B1 * | 1/2001 | Becker | 451/75 |
| 6,244,934 | B1 | 6/2001 | Miyai et al. | |
| 6,315,639 | B1 * | 11/2001 | Kipp | 451/38 |
| 6,468,360 | B1 | 10/2002 | Andrews | |
| 6,536,220 | B2 | 3/2003 | Visaisouk | |
| 6,695,685 | B2 | 2/2004 | Stratford et al. | |
| 6,890,246 | B2 | 5/2005 | Yamaharu | |
| 6,988,935 | B2 | 1/2006 | Shiraishi et al. | |
| 7,033,249 | B2 | 4/2006 | Spalteholz et al. | |
| 2002/0139395 | A1 | 10/2002 | Andrews | |
| 2003/0064665 | A1 * | 4/2003 | Opel | 451/40 |
| 2004/0255872 | A1 | 12/2004 | Johnson et al. | |

* cited by examiner

METHODS FOR CLEANING TUBULARS USING SOLID CARBON DIOXIDE

CROSS-REFERENCE TO RELATED APPLICATIONS

This application claims priority to U.S. Provisional Patent Application Ser. No. 61/050,715, filed on May 6, 2008, which is incorporated by reference herein.

BACKGROUND OF THE INVENTION

1. Field of the Invention

Embodiments of the present invention generally relate to carbon dioxide blasting. More specifically, embodiments of the present invention relate to cleaning tubulars using solidified carbon dioxide.

2. Description of the Related Art

Tubes are used throughout the chemical industry, generally in applications where heat transfer between one or more fluids inside of a tube and one or more fluids outside of the tube is desired. Typical examples of tubes in use within the chemical processing and refining industries include heat exchanger tubes and tubular reactors. In operation, scale, biological growth, corrosion byproducts or other contaminants can accumulate and/or deposit on the interior surfaces of the tubes. Similarly, reaction byproducts such as sintered catalyst, combustion byproducts, and scale can form or otherwise deposit within the tubes. Regular removal of the built-up deposits (or scale) on the interior surfaces of the tubes is necessary to ensure efficient operation and maximum productivity.

Conventionally, those deposits are removed, i.e. each tube is cleaned, by passing an abrasive device or chemical substance through the bore of the tube to dislodge or otherwise remove the deposits. For example, hydroblasting, sandblasting, and mechanical abrasion techniques have been used to remove deposits and clean the inner surfaces of the tubes. Hydroblasting uses water at pressures up to 40,000 psig. Hydroblasting generates large quantities of wastewater, frequently containing the contaminants removed from the tubes, which require additional treatment prior to disposal or recovery of the water. Sandblasting utilizes a sandblast medium or aggregate that also creates large quantities of solid waste, which requires additional treatment prior to disposal or recovery of the medium. Mechanical abrasion typically involves passing a brush through the tube to physically abrade the deposits from the tube.

However, such physical removal techniques, while effective from removing the unwanted deposits from the tubes, are so physically abrasive that the metal substrate beneath the deposits is actually etched away. Conventional chemical removal techniques can also have the same etching effect on the tubes, and are also extremely difficult to cleanup and discard post-treatment. Removal of the base metal substrate weakens the tubes and increases the likelihood of corrosion and/or structural weaknesses within the tube.

There is a need, therefore, for a removal system that can effectively and efficiently remove unwanted deposits from within a tube without structurally affecting the tube and without generating a large quantity of waste requiring treatment prior to disposal.

SUMMARY OF THE INVENTION

Systems and methods for the cleaning tubes are provided. In at least one specific embodiment, a flexible conduit having a nozzle disposed at a first end thereof can be disposed within the bore of a tubular to be cleaned. The nozzle can have an internal 5-15 degree tapered section with a length-to-diameter ratio of greater than about 2:1. The nozzle can have an outer diameter that is about 80% to 99% of the inner diameter of the tubular. A fluid suspension containing air and solid carbon dioxide can be passed through the nozzle, impinging the surrounding inner surface of the surrounding tubular as the nozzle is disposed within the tubular. The solid carbon dioxide and compressed air suspension can have a solids concentration of from about 0.1% to 10.0% solids. The solids delivery rate through the nozzle can range from about 0.5 lbs/minute to about 5 pounds/minute. The flow of the suspension through the nozzle can be controlled using a remote device.

BRIEF DESCRIPTION OF THE DRAWINGS

So that the manner in which the above recited features of the present invention can be understood in detail, a more particular description of the invention, briefly summarized above, can be had by reference to embodiments, some of which are illustrated in the appended drawings. It is to be noted, however, that the appended drawings illustrate only typical embodiments of this invention and are therefore not to be considered limiting of its scope, for the invention can admit to other equally effective embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" can in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1:
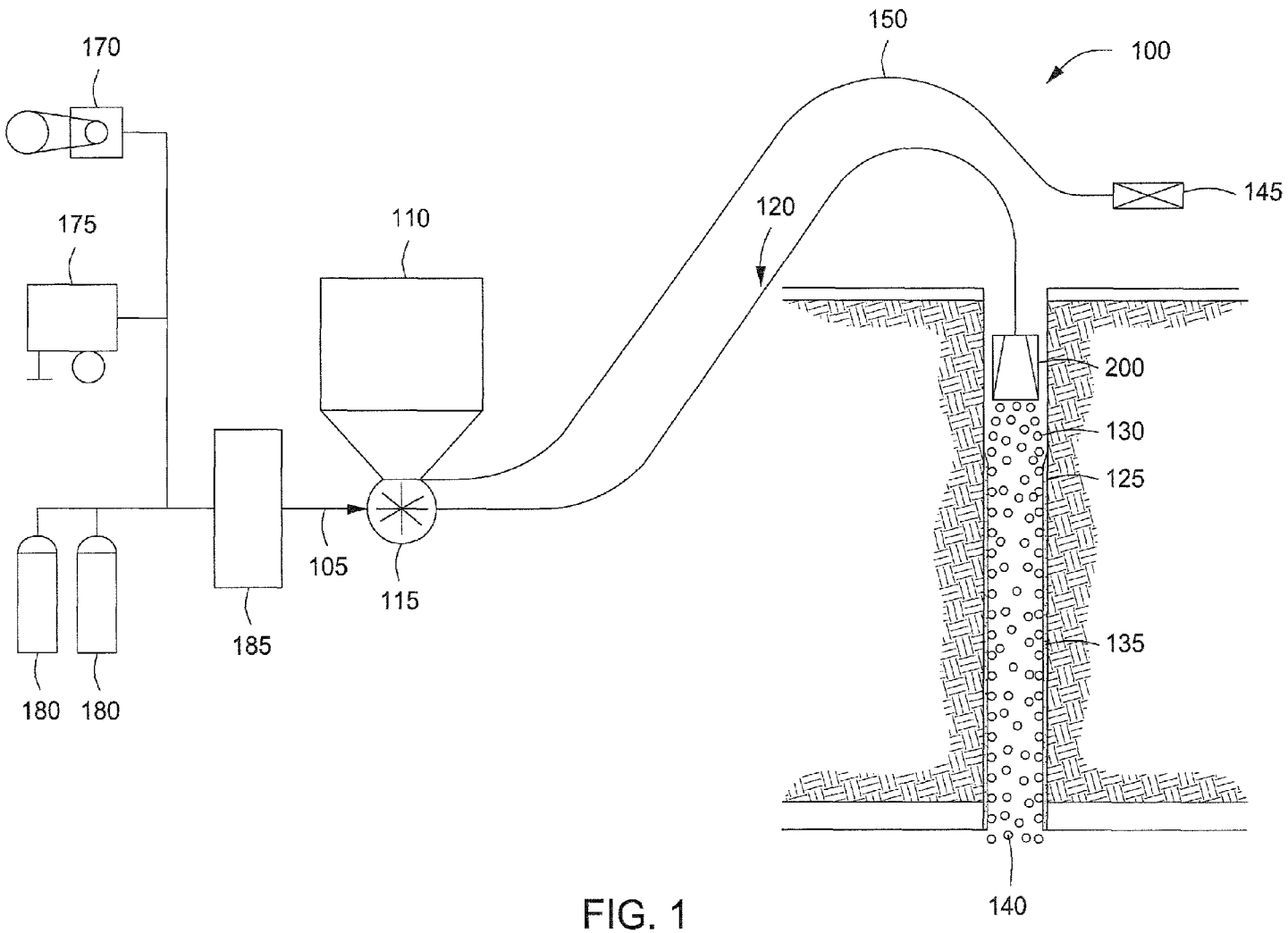
FIG. 1 depicts a schematic of an illustrative tubular cleaning system, according to one or more embodiments described.

FIG. 1 depicts a schematic of an illustrative tubular cleaning system 100, according to one or more embodiments. In at least one specific embodiment, the system 100 can include one or more storage hoppers 110, one or more feed valves 115, one or more flexible conduits 120, one or more remote controllers 145, and one or more nozzles 200. A blast medium can be disposed within the storage hopper 110. A carrier or transfer fluid, such as compressed air, via line 105 can be introduced to the feed valve 115 to form a suspension of the blast medium. The suspension can travel through the one or more flexible conduits 120, exiting the one or more nozzles 200. The one or more remote controllers 145 can be used to control the flow of the suspension through the flexible conduit 120 and hence through the nozzles 200. In operation, the blast medium exiting the nozzle 200 can impinge the inner surface of one or more tubulars 125 to be cleaned, removing at least a portion of any deposits 135 disposed thereon.

The blast medium can include any one or more physically abrasive materials or particles including, but not limited to, sand, silica, nut shells, glass beads, or any combination thereof. In one or more embodiments, the blast medium can be or include solid carbon dioxide particles ("dry ice"). As mentioned above, the blast medium can exit the storage hopper 110 via the one or more feed valves 115. One or more augers or screw conveyors (not shown) can be disposed within the storage hopper 110 to assist in the transport of the solid carbon dioxide particles to the feed valve 115. Although the blast medium can be any physically abrasive material, the present invention will be further described below, for simplicity and ease of description, with reference to solid carbon dioxide particles as the blast medium or at least one component of the blast medium.

The solid carbon dioxide particles can have any shape or physical geometry. For example, the solid carbon dioxide particles can be in the form of spherical pellets, elongated cylindrical prills, rice-shaped elongated prills, or any combination thereof. In one or more embodiments, the solid carbon dioxide particles can be in the form of rice-shaped elongated prills having an outside diameter of from about 0.05" to about 0.175"; about 0.075" to about 0.15"; or about 0.093" to about 0.125". In one or more embodiments, the solid carbon dioxide particles can have a bulk density of from about 10 lbs/ft$^3$ to about 80 lbs/ft$^3$; about 20 lbs/ft$^3$ to about 70 lbs/ft$^3$; or about 30 lbs/ft$^3$ to about 60 lbs/ft$^3$.

The storage hopper 110 can have a solid carbon dioxide particle capacity of from about 50 pounds to about 500 pounds; about 65 pounds to about 300 pounds; or about 75 pounds to about 200 pounds. The storage hopper 110 can be made of a metallic alloy including, but not limited to ferrous alloys, such as carbon and stainless steel alloys; non-ferrous alloys such as aluminum and aluminum alloys; or any combination thereof. In one or more embodiments, the storage hopper 110 can be fabricated using a non-metallic material resistant to cold embrittlement.

The feed valve 115 can be an airlock type valve, such as a rotary airlock valve. The feed valve 115 can be used to provide an even volumetric feed of solid carbon dioxide particles from the storage hopper 110 into the one or more flexible conduits 120. The feed valve 115 can provide an airlock transition point, sealing the compressed air in line 105 against pressure loss while maintaining a flow of solid carbon dioxide particles from the storage hopper 110. In one or more embodiments, the solid carbon dioxide particles can have a feed rate through the feed valve 115 of from about 0.1 lb/min to about 20 lb/min; about 0.2 lb/min to about 15 lb/min; or about 0.5 lb/min to about 10 lb/min. In one or more embodiments, the feed valve 115 can operate at a rotational speed of from about 1 RPM to about 100 RPM; about 2 RPM to about 75 RPM; or from about 5 RPM to about 50 RPM.

The carrier or transfer fluid, e.g. compressed air, via line 105 can be simultaneously introduced to the feed valve 115 to provide a suspension of solid carbon dioxide particles in the compressed air. In one or more embodiments, the carbon dioxide solids concentration in the suspension can range from a minimum of about 0.05% wt.; about 0.1% wt.; about 0.25% wt.; about 0.5% wt. or about 0.75% wt. to a maximum of about 7.5% wt.; about 10.0% wt.; about 15.0% wt.; or about 20.0% wt.

Compressed air can be supplied using one or more stationary compressors 170, one or more portable compressors 175, one or more air bottles 180, or any combination thereof. The pressure of the compressed air can range from a low of about 25 psig; about 50 psig; about 75 psig; or about 100 psig to a high of about 150 psig; about 200 psig; about 250 psig; about 300 psig; or about 500 psig. In one or more embodiments, the compressed air in line 105 can optionally pass through one or more air dryers 185 to remove entrained water from the compressed air. In one or more embodiments, the compressed air in line 105 can have a dew point of about −100° F.; about −80° F.; or about −40° F.

The suspension can exit the feed valve 115 via the flexible conduit 120. The inside diameter of the flexible conduit 120 can range from a minimum of about 0.125"; about 0.25"; or about 0.375" to a maximum of about 1.5"; about 1.75"; or about 2.0". The flexible conduit 120 can be made of any material that maintains flexibility and structural integrity at pressures up to 500 psig and very low temperatures, such as the temperature of dry ice, −109° F. For example, the operating temperature of the one or more flexible conduits 120 can be about −110° F.; about −105° F.; about −100° F.; or about −75° F., and the operating pressure can range from a low of about 25 psig; about 50 psig; about 75 psig; or about 100 psig to a high of about 150 psig; about 200 psig; about 250 psig; about 300 psig; or about 500 psig. In one or more specific embodiments, the flexible conduit 120 can be made of an elastomeric material, such as Synflex®, manufactured by the Eaton Corporation.

The remote switch 145 can transmit a signal via one or more control conduits 150 to the one or more feed valves 115 thereby stopping and starting the rotation of the feed valve 115. Since a physical obstruction in the flexible conduit and/or nozzle is not necessary to halt the flow of the suspension, the remote switch 145 can be mounted independent of the flexible conduit 120 and/or nozzle 200. By disposing the switch 145 remote from the flexible conduit 120 and/or nozzle 200, both the flexible conduit 120 and nozzle 200 can remain open and unobstructed at all times. The use of an open, unobstructed flexible conduit 120 and nozzle 200 can reduce the likelihood of blockages caused by freezing and/or accumulation of blast medium therein. In one or more embodiments, the switch 145 can be a pneumatically operated foot switch, for example a Control International 894 Series foot switch, and the one or more control conduits 150 can be flexible pneumatic tubing. In one or more embodiments, the switch 145 can be an electrically operated foot switch, for example a Square D model 9002AW2 foot switch, and the one or more control conduits 150 can be one or more electrical conductors.

Figure 2:
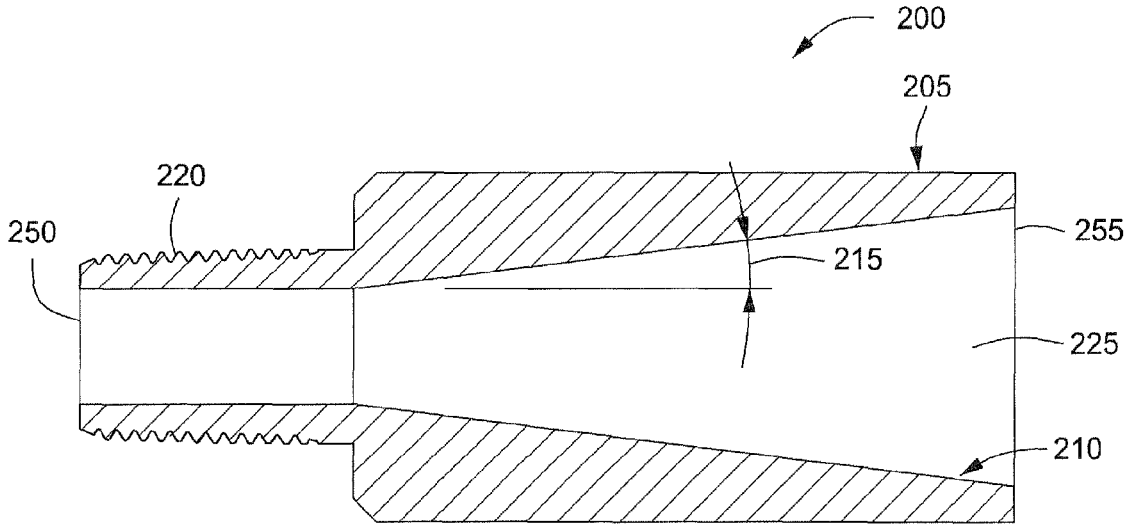
FIG. 2 depicts a cross-sectional view of an illustrative nozzle, according to one or more embodiments described.

FIG. 2 depicts a cross sectional view of an illustrative nozzle 200 according to one or more embodiments. In one or more embodiments, the nozzle 200 can include an outer surface 205, an inner surface 210, and a connector 220. The connector 220 provides for attachment of the nozzle 200 to the one or more flexible conduits 120. In one or more embodiments, the nozzle 200 can have an unobstructed bore or annulus 225 extending therethrough from a first end 250 that is connected to the one or more flexible conduits 120 to a second end 255 through which the suspension can be discharged.

The inner surface 210 is defined by the bore 225 through the nozzle 200. The inner surface 210 can be tapered with respect to the longitudinal axis of the nozzle 200 by an angle 215. For example, the inner surface 210 can be tapered or flared from the first end 250 of the nozzle 200 to the second end 255 of the nozzle 200. The angle 215 represents the slope or taper of the inner surface 210.

In one or more embodiments, the bore at the open second end 255 of the nozzle 200 can have a diameter greater than the bore at the first end 250 of the nozzle 200 attached to the conduit 120. In one or more embodiments, the angle between the inner surface 210 and the longitudinal centerline of the nozzle 200 can range from a low of about 2 degrees; about 3 degrees; about 5 degrees; or about 5.5 degrees to a high of about 7 degrees; about 10 degrees; about 12 degrees; or about 15 degrees.

In one or more embodiments, the length-to-diameter ratio for the nozzle 200 can be about 1:1 or greater; about 2:1 or greater; about 3:1 or greater; about 4:1 or greater; about 5:1 or greater or about 7:1 or greater. The nozzle 200 can have a length-to-diameter ratio of from about 1:1 to about 15:1; about 2:1 to about 10:1; or about 2:1 to about 7:1. It should be noted that the ratio of nozzle length to nozzle diameter can be established based upon observed deflection of the one or more tubulars 125 because the tubulars 125 to be cleaned can be distorted or deflected by internal or external forces. Such forces can include but are not limited to thermal cycling, hydraulic pressure, or any combination thereof.

The one or more connectors 220 can be disposed in, on, or about the first end of the nozzle 200. In one or more embodiments, the one or more connectors 220 can include, but are not limited to straight threads, tapered threads, hydraulic fittings, quarter-turn fittings (e.g. "Chicago" fittings), camlock fittings, quick connect fittings, or any combination thereof.

The nozzle 200 can be made of any material that is softer than the one or more tubulars 125 to prevent the nozzle from scratching, scarring or otherwise damaging the inner surface of the one or more tubulars 125. For example, the nozzle 200 can be made of ferrous alloys including carbon and stainless steels. In one or more embodiments, the nozzle 200 can be made of or include one or more non-ferrous alloys including aluminum alloys. In one or more embodiments, the nozzle 200 can be made of or include a composite material including one or more ferrous alloys, one or more non-ferrous alloys, one or more non-metallic compounds, or any combination thereof.

In one or more embodiments, the outside diameter of the nozzle 200 can be smaller than the inside diameter of the one or more tubulars 125 as depicted in FIG. 1. In one or more embodiments, the outside diameter of the one or more nozzles 200 can be about 75%; about 80%; about 85%; about 80%; about 95%; or about 99% of the inside diameter of the tubular 125. In one or more embodiments, the outside diameter of the one or more nozzles 200 can be about 0.001"; about 0.003"; about 0.005"; about 0.007"; or about 0.010" less than the inside diameter of the one or more tubulars 125. In one or more embodiments, the inside diameter of the one or more tubulars 125 can range from a low of about 0.1"; about 0.125"; or about 0.25"; to a high of about 2"; about 2.5"; about 3"; about 4"; or about 6".

The tubulars 125 can have any shape and size. Typically, the tubular 125 has a circular cross-section and is cylindrical in shape. However, the tubular 125 can also have a square, elliptical, or other shape or cross section. In one or more embodiments, the tubulars 125 can be made of a material having a high thermal conductivity, for example one or more metals or metal alloys, to promote heat transfer during normal operation. In one or more embodiments, the tubulars 125 can be made of brass; bronze; carbon steel; stainless steel; nickel alloys, such as Inconel or Hastelloy; or any combination thereof.

One or more solids 135 can be deposited on the inner wall of the one or more tubulars 125. The nature, physical properties and composition of the one or more solids 135 can depend upon the material that passes through the tubulars during normal operations. In one or more embodiments, where the one or more tubulars are in cooling service, the solids 135 can include, but are not limited to biological growth, crustaceans, scale, corrosion, or any combination thereof. In one or more embodiments, where the one or more tubulars 125 are in reactor service, the solids 135 can include, but are not limited to combustion byproducts, metal oxides, sintered catalyst, reaction byproducts, or any combination thereof. In one or more embodiments, the one or more solids 135 can be present as a continuous scale, having a thickness of from about 1 mil to about 500 mils; about 2 mils to about 350 mils; or about 3 mils to about 250 mils.

Figure 3:
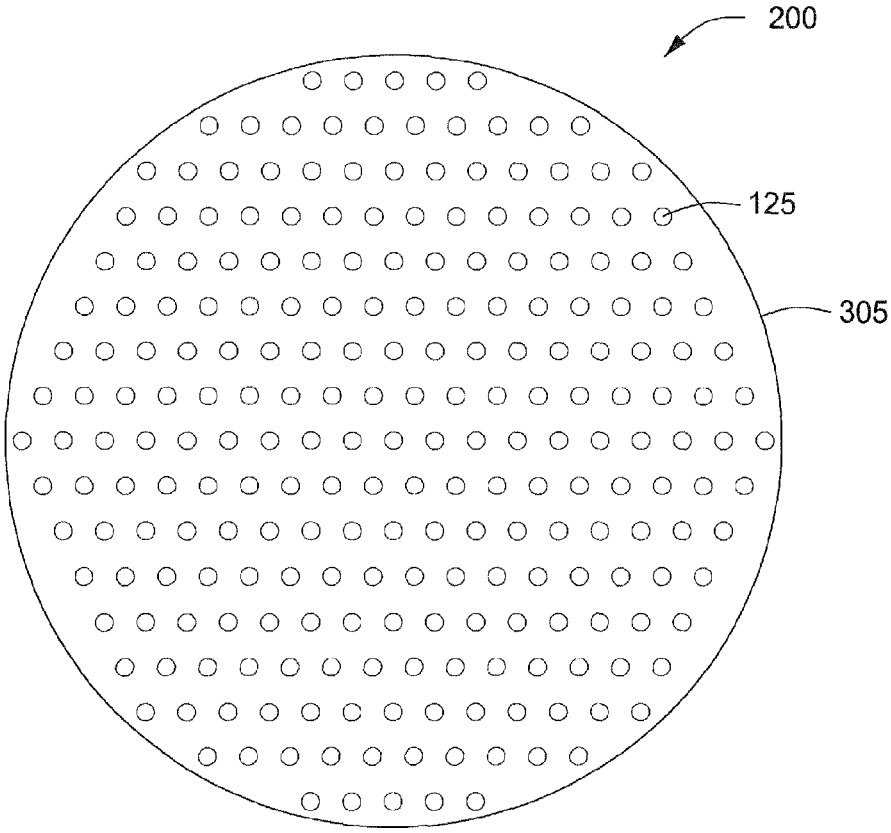
FIG. 3 depicts a plan view of an illustrative vessel having a plurality of tubulars disposed therein according to one or more embodiments.

FIG. 3 depicts a plan view of an illustrative vessel 305 having a plurality of tubulars 125 disposed therein according to one or more embodiments. The vessel 305 can be any housing or container having one or more shell-and-tube sections, including but not limited to tubular reactors and heat exchangers. In one or more embodiments, the plurality of tubulars 125 can be disposed within the vessel 305 using any pattern or frequency, for example the plurality of tubulars 125 can be located using a regular triangular pitch, or regular square pitch. In one or more embodiments, the inside diameter of the vessel 305 can range from a low of about 2"; about 4"; or about 6" to a high of about 20 feet; about 25 feet; about 30 feet; or about 40 feet. In one or more embodiments, the one or more tubulars 125 within the vessel 305 can have the same or different diameters. In one or more embodiments, the vessel 305 can contain about 4 to about 60,000; about 4 to about 50,000; or about 4 to about 40,000 tubulars 125. In one or more embodiments, the vessel 305 can have an operating temperature of from about −200° F. to about 3,000° F.; from about −100° F. to about 2,500° F.; or about −50° F. to about 2,000° F. In one or more embodiments, the vessel 305 can have an operating pressure of from about 0 psia to about 2,000 psia; about 15 psia to about 2,000 psia; or about 15 psia to about 1,500 psia. In one or more embodiments, the plurality of tubulars 125 disposed within the vessel 305 can have equal or unequal lengths. In one or more embodiments, each of the tubulars 125 can have a length of from about 6 inches to about 50 feet; about 1 foot to about 40 feet; or about 2 feet to about 30 feet. The vessel 305 can be disposed vertically, horizontally, or at any angle therebetween. In one or more specific embodiments, the vessel 305 can be vertical having the plurality of tubulars 125 disposed vertically therein, with a first end of the tubular at the top and a second end of the tubular at the bottom.

Figure 4:
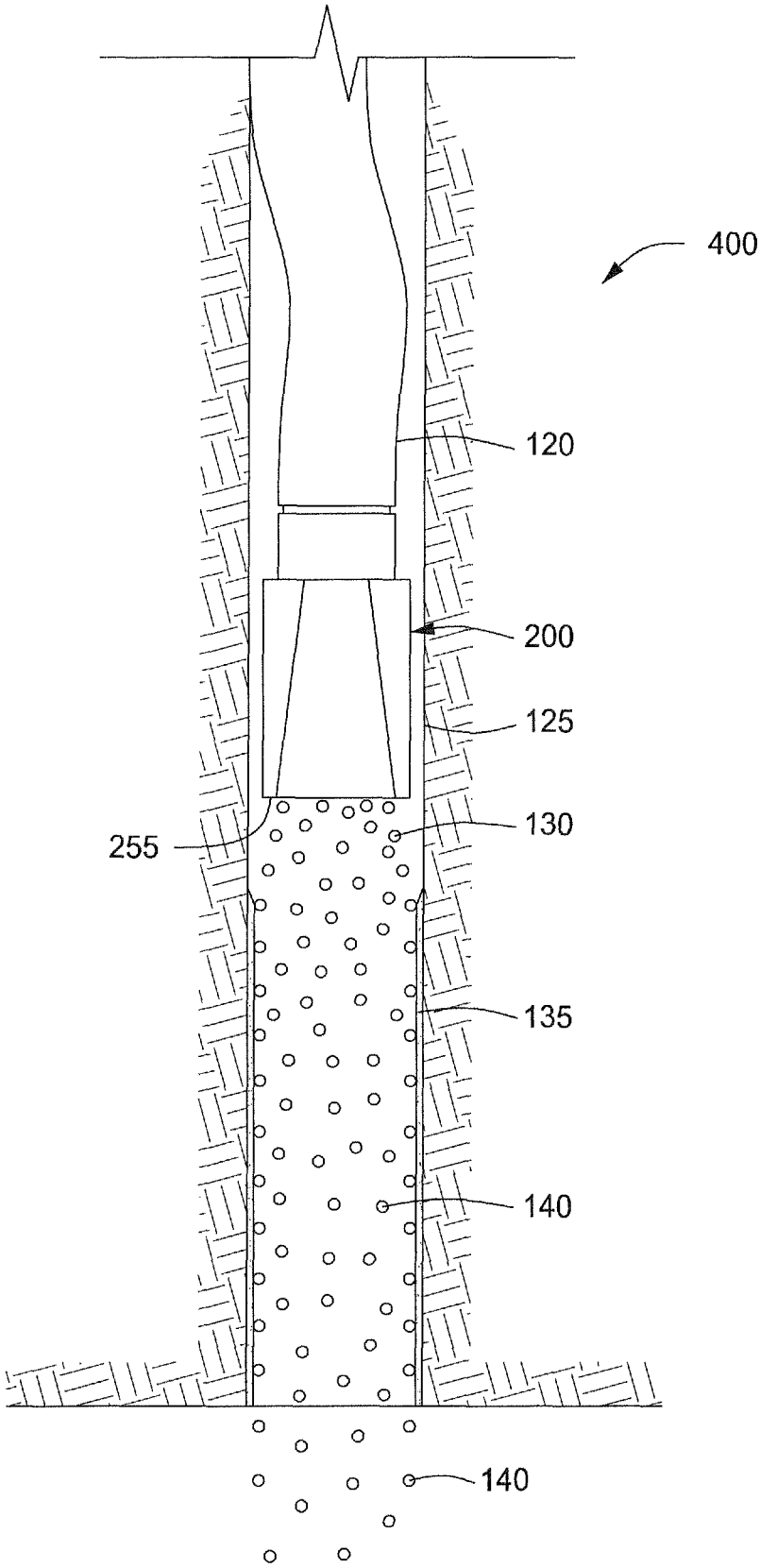
FIG. 4 depicts a schematic of an illustrative tubular within the vessel depicted in FIG. 3 having the system 100 disposed therein for performing a cleaning operation, according to one or more embodiments.

FIG. 4 depicts a schematic of an illustrative tubular 125 within the vessel 305 depicted in FIG. 3 having the system 100 disposed therein for performing a cleaning operation, according to one or more embodiments. In one or more embodiments, a flexible conduit 120 having a nozzle 200 disposed at an end thereof can be located within the tubular 125 to be cleaned. The nozzle 200 can have a 5-15 degree tapered section with a length to diameter ratio of greater than about 2:1. The nozzle 200 can have an outer diameter that is about 80% to about 99.9% of the inner diameter of the tubular 125. The suspension, having from about 0.1% wt. to about 10% wt. solid carbon dioxide in compressed air, can be passed through the nozzle 200 at a solids delivery rate of about 0.5 lbs/min to about 5 lbs/min. The compressed air via line 105 (see FIG. 1) and solid carbon dioxide particle feed rate via the feed valve 115 (see FIG. 1) can be adjusted to maintain a desired solids delivery rate. The flow of suspension through the nozzle 200 can be remotely controlled using one or more switches 145 (see FIG. 1). The inner diameter of the tubular 125 can be cleaned by impinging the carbon dioxide solids 130 against the inner diameter of the tubular 125.

In one or more embodiments, the nozzle 200 and attached flexible conduit 120 can be passed in a first direction, from the first end to the second end of the one or more tubulars 125. In one or more embodiments, the nozzle 200 and attached flexible conduit 120 can be passed in a second direction, from the second end to the first end of the one or more tubulars 125. The passage speed of the nozzle 200 and attached flexible conduit 120 through the tubular 125 can depend upon the thickness and physical properties of the deposits 135. In one or more embodiments, the average speed of the nozzle 200 through the tubular 125 can range from a low of about 1 inch/minute; about 2 inches/minute; about 3 inches/minute; or about 5 inches/minute to a high of about 50 inches/minute; about 75 inches/minute; or about 100 inches/minute. In one or more embodiments, the nozzle can be passed through all or a portion of a single tubular 125 multiple times as necessary to remove thick and/or resilient deposits 135 therein. In one or more embodiments, the flow rate of blast media through the nozzle 200 can be increased by increasing the speed of the feed valve 15 to remove any deposits 135 on the inner diameter of the one or more tubulars 125. In one or more embodiments, the flow of solid carbon dioxide particles through the nozzle 200 can be adjusted to limit the temperature drop of the tubular 125 to about 40° F. or less; about 30° F. or less; about 20° F. or less; or about 10° F. or less.

In operation, the suspension within the one or more flexible conduits 120 can be discharged through the open second end 255 of the one or more nozzles 200 as the nozzle and attached conduit are passed through the one or more tubulars 125. A plurality of carbon dioxide particles 130 can exit the one or more nozzles 200, forming a pattern or distribution extending therefrom. In one or more embodiments, the discharge pattern formed by the plurality of solid carbon dioxide particles 130 can be conical, diverging radially outward as the distance from the one or more nozzles 200 increases. In one or more embodiments, about 60% wt. or more; about 70% wt. or more; about 75% wt. or more; about 80% wt. or more; about 85% wt. or more; or about 90% wt. or more of the plurality of solid carbon dioxide particles 130 exiting the one or more nozzles 200 can be disposed about the perimeter of the conical distribution pattern.

The solid carbon dioxide particles 130 exiting the one or more nozzles 200 can forcefully impinge upon the solids 135 disposed on the inner surface of the one or more tubulars 125. The physical impingement of the solid carbon dioxide particles 130 on the surface of the solids 135 can fracture the surface of the solids 135. The explosive sublimation of the solid carbon dioxide particles to gaseous carbon dioxide can lift the solid particulates 140 from the inner surface of the one or more tubulars 125. The fractured solids 140 can exit the tubular 125.

The fractured solids 140 exiting the tubular 125 will not contain any additional contaminants when using solid carbon dioxide particles as the blast media. The sublimation of the solid carbon dioxide particles during blasting can reduce the volume of waste generated since the gaseous carbon dioxide can be allowed to escape to the atmosphere. In contrast, the use of a conventional blast medium, such as sand or silica based aggregates, can increase the volume of waste generated since the blast media and deposits removed from the tubular are thoroughly mixed.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A method for cleaning one or more tubulars, comprising:

mixing a plurality of carbon dioxide solids in a compressed air stream to form a fluid suspension containing from about 0.75 wt % to about 7.5 wt % carbon dioxide solids, wherein the carbon dioxide solids are in the form of rice-shaped elongated prills having an outside diameter from about 0.093 inches to about 0.125 inches and a bulk density from about 30 lbs/ft$^3$ to about 60 lbs/ft$^3$, and wherein a pressure of the compressed air is from about 100 psig to about 300 psig;

flowing the fluid suspension through a flexible conduit having a nozzle disposed at an end thereof, wherein the nozzle is coupled to the flexible conduit with a connector, wherein the connector is integral with the nozzle and has threads disposed on an outer surface thereof, wherein the flexible conduit, the connector, and the nozzle all remain open and unobstructed when the fluid suspension is flowing therethrough, and wherein a feed rate of the carbon dioxide solids is from about 0.5 lb/min to about 10 lb/min;

locating the nozzle within a tubular, wherein an outer diameter of the nozzle is about 95% to about 99.9% of an inner diameter of the tubular;

cleaning an inner surface of the tubular by impinging the carbon dioxide solids against the inner surface of the tubular, wherein the carbon dioxide solids form a conical pattern after exiting the nozzle, and wherein a minimum of 70 wt % of the carbon dioxide solids are distributed about the perimeter of the conical pattern; and remotely controlling the flow of the fluid suspension through the nozzle to limit a temperature drop of the surface to about 20° F. or less, wherein:

the nozzle has a bore defined by a single tapered inner surface such that the bore has a frustoconical shape extending from a first end of the nozzle to a second end of the nozzle, a diameter of the bore at the second end of the nozzle is about 2.4 times a diameter of the bore at the first end of the nozzle, an angle between the single tapered inner surface and a longitudinal centerline of the nozzle is from about 7° to about 12°, the nozzle has a length to outer diameter ratio from about 2:1 to about 10:1, and the first end of the nozzle is adjacent the end of the flexible conduit.

2. The method of claim 1, wherein the temperature drop of the surface is limited to about 10° F. or less, wherein the angle between the single tapered inner surface and the longitudinal centerline of the nozzle is from about 7° to about 10°, wherein the nozzle has a length to an outer diameter ratio from about 5:1 to about 7:1.

3. The method of claim 1, wherein the outer diameter of the nozzle is from about 0.001 inches to about 0.01 inches less than the inner diameter of the tubular.

4. The method of claim 1, wherein the inner diameter of the tubular is about 0.25 inches to about 6 inches.

5. The method of claim 1, wherein the flow of the fluid suspension through the nozzle is remotely controlled to limit the temperature drop of the surface to about 10° F. or less.

6. The method of claim 1, further comprising moving the nozzle within the tubular at a speed of about 1 inch per minute to about 100 inches per minute.

7. A method for cleaning one or more tubulars, comprising:

mixing a plurality of carbon dioxide solids in a compressed air stream to form a fluid suspension containing from about 0.75 wt % to about 7.5 wt % carbon dioxide solids, wherein the carbon dioxide solids are in the form of rice-shaped elongated prills having an outside diameter from about 0.093 inches to about 0.125 inches and a bulk density from about 30 lbs/ft$^3$ to about 60 lbs/ft$^3$, and wherein a pressure of the compressed air is from about 100 psig to about 300 psig;

flowing the fluid suspension through a flexible conduit having a nozzle disposed at an end thereof, wherein the nozzle is coupled to the flexible conduit with a connector, wherein the connector is integral with the nozzle and has threads disposed on an outer surface thereof, wherein the flexible conduit, the connector, and the nozzle all remain open and unobstructed when the fluid suspension is flowing therethrough, and wherein a feed rate of the carbon dioxide solids is from about 0.5 lb/min to about 10 lb/min;

locating the nozzle within a tubular, wherein an outer diameter of the nozzle is about 95% to about 99.9% of an inner diameter of the tubular;

cleaning an inner surface of the tubular by impinging the carbon dioxide solids against the inner surface of the tubular, wherein the carbon dioxide solids form a conical pattern after exiting the nozzle, and wherein a minimum of 90 wt % of the carbon dioxide solids are distributed about the perimeter of the conical pattern; and remotely controlling the flow of the fluid suspension through the nozzle to limit a temperature drop of the surface to about 10° F. or less, wherein:

the nozzle has a bore defined by a single tapered inner surface such that the bore has a frustoconical shape extending from a first end of the nozzle to a second end of the nozzle, a diameter of the bore at the second end of the nozzle is about 2.4 times a diameter of the bore at the first end of the nozzle, an angle between the single tapered inner surface and a longitudinal centerline of the nozzle is from about 7° to about 10°, the nozzle has a length to outer diameter ratio from about 5:1 to about 7:1, and the first end of the nozzle is adjacent the end of the flexible conduit.

8. The method of claim 7, wherein the outer diameter of the nozzle is from about 0.001 inches to about 0.01 inches less than the inner diameter of the tubular.

9. The method of claim 7, wherein the inner diameter of the tubular is about 0.25 inches to about 6 inches.

10. The method of claim 7, further comprising moving the nozzle within the tubular at a speed of about 1 inch per minute to about 100 inches per minute.

11. A method for cleaning one or more tubulars, comprising:

mixing a plurality of carbon dioxide solids in a compressed air stream to form a fluid suspension containing from about 0.75 wt % to about 7.5 wt % carbon dioxide solids, wherein the carbon dioxide solids are in the form of rice-shaped elongated prills having an outside diameter from about 0.093 inches to about 0.125 inches and a bulk density from about 30 lbs/ft$^3$ to about 60 lbs/ft$^3$, and wherein a pressure of the compressed air is from about 100 psig to about 300 psig;

flowing the fluid suspension through a flexible conduit having a nozzle disposed at an end thereof, wherein the nozzle is coupled to the flexible conduit with a connector, wherein the connector is integral with the nozzle and has threads disposed on an outer surface thereof, wherein the flexible conduit, the connector, and the nozzle all remain open and unobstructed when the fluid suspension is flowing therethrough, and wherein a feed rate of the carbon dioxide solids is from about 0.5 lb/min to about 5 lb/min;

locating the nozzle within a tubular, wherein an outer diameter of the nozzle is about 99% to about 99.9% of an inner diameter of the tubular, and wherein the outer diameter of the nozzle is from about 0.001 inches to about 0.01 inches less than the inner diameter of the tubular;

cleaning an inner surface of the tubular by impinging the carbon dioxide solids against the inner surface of the tubular, wherein the carbon dioxide solids form a conical pattern after exiting the nozzle, and wherein a minimum of 90 wt % of the carbon dioxide solids are distributed about the perimeter of the conical pattern, wherein cleaning the inner surface of the tubular further comprises moving the flexible conduit and nozzle coaxially along a longitudinal axis of the tubular while maintaining an outer surface of the nozzle parallel to the inner surface of the tubular; and remotely controlling the flow of the fluid suspension through the nozzle to limit a temperature drop of the surface to about 10° F. or less, wherein:

the nozzle has a bore defined by a single tapered inner surface such that the bore has a frustoconical shape extending from a first end of the nozzle to a second end of the nozzle, a diameter of the bore at the second end of the nozzle is about 2.4 times a diameter of the bore at the first end of the nozzle, an angle between the single tapered inner surface and a longitudinal centerline of the nozzle is from about 7° to about 10°, the nozzle has a length to outer diameter ratio from about 5:1 to about 7:1, and the first end of the nozzle is adjacent the end of the flexible conduit.

12. The method of claim 11, wherein the inner diameter of the tubular is about 0.25 inches to about 6 inches.

13. The method of claim 11, wherein the flexible conduit and nozzle are moved at a speed of about 1 inch per minute to about 100 inches per minute along the longitudinal axis of the tubular.

* * * * *